United States Patent [19]

Beloff

[11] Patent Number: 4,907,604

[45] Date of Patent: Mar. 13, 1990

[54] DEVICE FOR EXTINGUISHING AND SAVING CIGARS

[75] Inventor: Arthur L. Beloff, Milford, Conn.

[73] Assignee: Cigar Savor, Inc., Hamden, Conn.

[21] Appl. No.: 185,848

[22] Filed: Apr. 25, 1988

Related U.S. Application Data

[63] Continuation-in-part of Ser. No. 42,050, Apr. 24, 1987, Pat. No. 4,777,968.

[51] Int. Cl.[4] ..... A24F 15/08; A24F 15/18

[52] U.S. Cl. ..... 131/256; 131/254; 131/233; 131/238

[58] Field of Search ..... 131/256, 254, 233, 238

[56] References Cited

U.S. PATENT DOCUMENTS

| | | |
|---|---|---|
| 450,312 | 4/1891 | Hieatzman . |
| 802,300 | 10/1905 | MacLachlan . |
| 1,138,772 | 5/1915 | Matthews . |
| 1,204,053 | 11/1916 | Moore . |
| 1,764,862 | 6/1930 | Vogelsang . |
| 2,514,876 | 7/1950 | Kost . |
| 2,575,261 | 11/1951 | De La Torre . |
| 2,715,961 | 8/1955 | Field . |
| 3,173,641 | 3/1965 | Dorrance . |
| 3,978,981 | 9/1976 | Musick . |
| 4,168,129 | 9/1979 | Herrnring . |
| 4,263,923 | 4/1981 | Landuydt . |
| 4,660,575 | 4/1987 | Andreason et al. . |

FOREIGN PATENT DOCUMENTS

| | | |
|---|---|---|
| 212485 | 11/1940 | Switzerland . |
| 248289 | 4/1947 | Switzerland . |
| 447501 | 3/1968 | Switzerland . |

*Primary Examiner*—V. Millin

*Attorney, Agent, or Firm*—Bachman & LaPointe

[57] ABSTRACT

The present invention relates to a device for rapidly extinguishing a lighted cigar and for saving the extinguished cigar for later consumption. The device comprises a hollow cylindrical tube having a closed end portion and an open end opposed to said closed end portion and a removable cap sized to fit within the open end of the tube for forming a substantially air tight container so as to promote rapid extinguishment of the lighted cigar. The cap in a preferred embodiment has a bore configured to receive and reshape an unlit, wetted tip of the extinguished cigar and a pin having a pointed end for punching a hole in the unlit cigar tip. The device further includes an adjustable snuffer for accommodating cigars of different lengths.

14 Claims, 1 Drawing Sheet

DEVICE FOR EXTINGUISHING AND SAVING CIGARS

CROSS REFERENCE TO RELATED APPLICATION

This application is a continuation-in-part of allowed U.S patent application Ser. No. 042,050, filed Apr. 24, 1987, now Pat. No. 4,777, 968 to Arthur L. Beloff for A Device for Extinguishing Cigars.

BACKGROUND OF THE INVENTION

The present invention relates to a device for rapidly extinguishing a lighted cigar and saving it for later consumption.

Cigar smokers, because of the length of time required to smoke an entire cigar, often need to extinguish a cigar before it is completely consumed. As more and more public facilities become designated non-smoking sites, this problem becomes even more pronounced. Devices for extinguishing lighted smoking materials and/or saving them are known in the art. For example, U.S. Pat. No. 1,764,862 to Vogelsang illustrates a portable cigar or cigarette extinguisher comprising a hollow member having a cylindrical bore for receiving the cigar. The hollow member may be used with a fixed or detachable base so that when placed on a flat surface it is closed in an airtight manner. The base may also be used as a receptacle for ashes. If desired, a second base may be provided to be used as a lid or a cover.

U.S. Pat. No. 3,173,641 to Dorrance illustrates an ash tray and snuffer device. The Dorrance device comprises a hollow receptacle open at one end and closed at the other which is mounted to a base by a wire support structure. While this device is portable, one can not easily put it into the pocket of one's clothing. Further, there is no means to prevent tobacco juices from coming into contact with and staining the user's clothing.

U.S. Pat. No. 302,300 to Maclachlan illustrates another cigar extinguisher and retention device. The Maclachlan device comprises a hollow, conical cap and an elastic tube for covering the extinguished cigar. To extingish a lighted cigar using the Maclachlan device, one inserts the burning end into the cap and unrolls the elastic tube over the cigar. Hereagain though, the wetted end of the cigar remains exposed.

U.S. Pat. No. 450,312 to Hieatzman illustrates a closed case for extinguishing and preserving a cigar. The Hieatzman device comprises a base portion having a blade type device for cutting off the burning portion of the lighted cigar. The base portion includes a hollow portion for receiving the cigar. The device further includes a telescopic portion which fits into the hollow portion to form a sealed container. One problem associated with this device is the possibility of damaging the cigar while it is being preserved. The telescoping feature of Hieatzman can lead to cigar damage if the second portion is inadvertently forced toward or against the base portion.

Another type of cigar holder is illustrated in U.S. Pat. No. 3,978,981 to Musick. This device differs from the other devices in that it is not intended to be used as a cigar extinguisher. The Musick device comprises a receptacle for receiving the lighted end of the cigar and a separate cap for receiving the wet end of the cigar. The receptacle has a mesh venting screen to permit the cigar to burn. As a result of this construction, this type of device could not easily be carried in a pocket of a user.

As the cigar continues to burn and give off smoke, a user would inhale the smoke. Further, the user's clothing will become permeated with the odor of smoke.

Still other types of holders for lighted tobacco products are illustrated in Swiss Pat. Nos. 212,845 and 248,289. The device in the '845 patent uses a spring operated snuffer to help extinguish the cigar or cigarette. It lacks however a cap for creating sufficient pressure to substantially instantaneously extinguish the cigar or cigarette and a cap having a bore designed to reshape the tip of a cigar. The '289 patent lacks a spring actuated snuffer, a cap capable of creating sufficient pressure to substantially instantaneously extinguish a cigar and a bore in the cap for reshaping the cigar tip.

SUMMARY OF THE INVENTION

The present invention relates to a device for rapidly extinguishing a lighted cigar and for saving the extinguished cigar for later consumption. The device comprises a hollow cylindrical tube having a closed end portion, an open end opposed to the closed end portion, an adjustable snuffer within the tube, and a removable cap sized to fit within the open end to form with the tube a substantially airtight container for rapidly extinguishing the lighted cigar. The cap has a bore for receiving the normally flattened, unlit, wetted tip of the cigar. The bore is shaped or configured to reform the tip of the cigar into a substantially perfect taper. In addition, the cap is provided with a pin having a pointed end. The pin punches a hole in the reformed cigar tip so that upon removal of the cigar from the device, a user need only light a match to continue smoking the cigar.

It has been found that the device of the present invention enables a lighted cigar to be extinguished substantially instantaneously. As a result, the taste of the cigar is not adversely affected. In fact, the moisture in the tip is locked in the device and thus the cigar is kept substantially humidor-fresh. In addition, there is no significant heat build-up in the device.

It is an object of this invention to provide a device for extinguishing and saving a cigar.

It is a further object of the present invention to provide a device as above which will accommodate cigars of different lengths and dimensions.

It is yet a further object of the present invention to provide a device as above which will extinguish a cigar and not adversely affect the taste of the cigar.

It is still a further object of the present invention to provide a device as above which may be carried within the pocket of the user's apparel.

These and further objects and advantages will become more apparent from the following description and drawings in which like references numerals depict like elements.

DETAILED DESCRIPTION OF THE INVENTION

Figures 1, 2, 3:
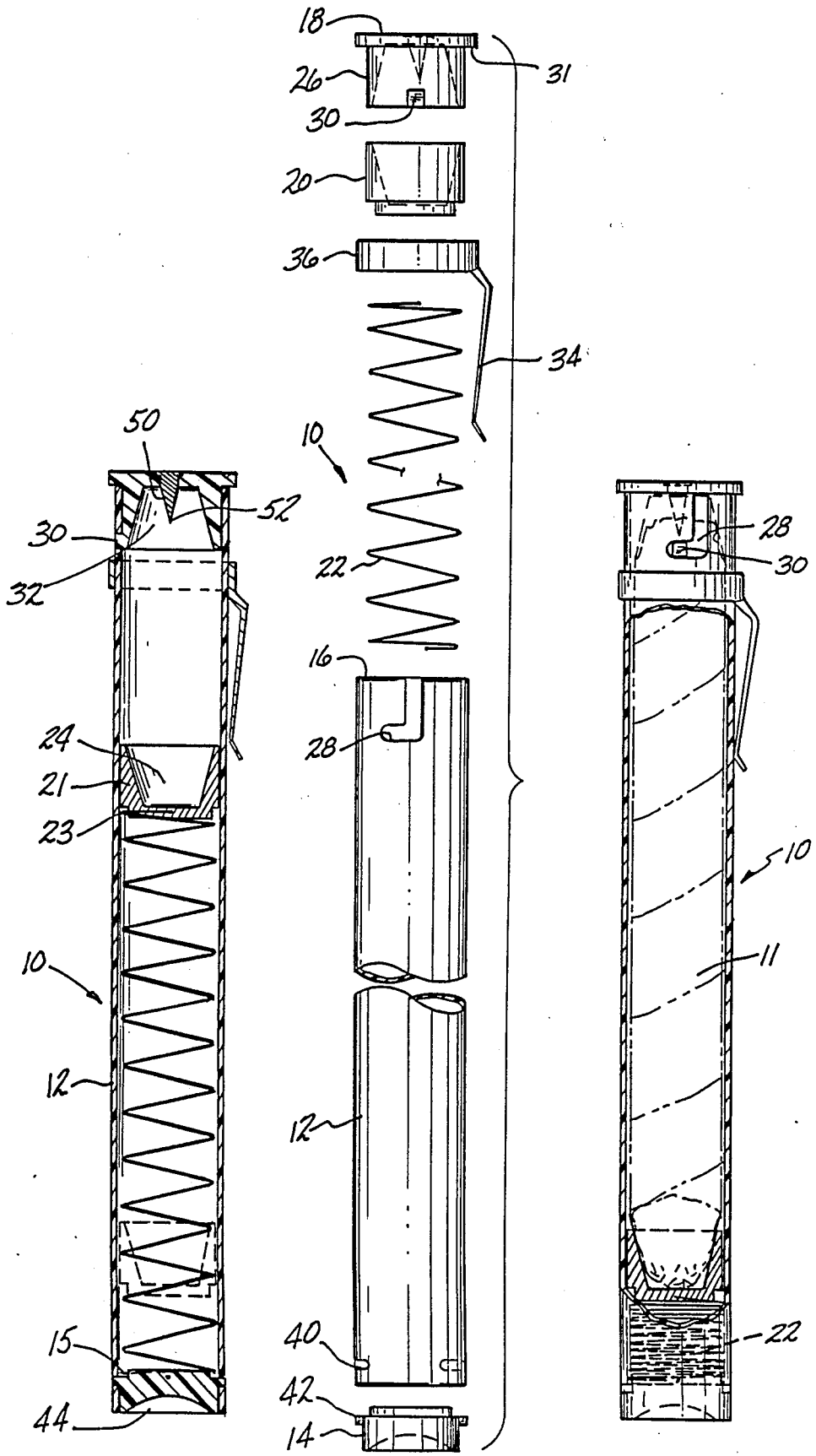
FIG. 1 is a cross sectional view of the cigar extinguishing and preserving device of the present invention.
FIG. 2 is an exploded view showing the various components of the device of FIG. 1.
FIG. 3 is a view in partial cross section illustrating a cigar housed within the device of the present invention.

As previously discussed, the device of the present invention is designed to rapidly extinguish a lighted cigar and save it for later consumption. It has been found that a device in accordance with the present invention will extinguish a cigar substantially instantaneously. This is desirable both from the standpoint of preventing heat build-up and from the standpoint of retaining a cigar's taste. The device is further designed to reshape the normally flattened, unlit tip of the cigar, to prevent the transfer of unsightly tobacco juices and smoke odors to the user's apparel, and to accommodate cigars of different lengths and diameters.

Referring now to the figures, the device 10 comprises a hollow cylindrical tube 12 having a closed end 13 and an open end 16. The tube 12 may have any desired length and any desired inner and outer diameters. Preferably, the tube is of a size sufficient to permit the accommodation of cigars of different lengths and diameters.

The tube 12 is formed from a material which is highly resistant to impact in order to fully protect the cigar. In view of the fact that the device will initially contain a lighted cigar, the tube material is also substantially noncombustible and has a relatively high melting point. Suitable materials for the tube include but are not limited to plastics such as polypropylene, polyethylene, polycarbonate and nylon. If desired, the tube 12 could be formed from a metal or metal alloy which does not transmit significant amounts of heat to the user.

The closed end 13 of the tube 12 may be formed by a removable, substantially cylindrical, solid end cap 14 inserted within an opening 17 in the tube and made from the same material as the tube 12. A removable end cap is useful in removing ashes from the interior of the tube and/or servicing internal components such as spring 22.

The end cap 14 may be secured to the tube 12 in any desired manner. For example, the tube 12 may be provided with substantially L-shaped slots 40 on opposed walls and the cap 14 may be provided with integral flanges 42 for engaging the slots and positively locking the cap 14 to the tube 12. Alternatively, the end cap 14 may be fixedly secured to the tube 12 by an adhesive.

If desired, a slot 44 may be provided in the cap 14 to facilitate removal of the cap from the tube. The slot may have a thickness sufficient to accommodate the edge of a tool such as a screwdriver or the edge of a coin.

In an alternative embodiment, the end cap 14 may have a lip portion not shown which abuts against an end wall of the tube 12. The lip portion insures proper positioning of the cap 14 relative to the tube 12 and helps form a good airtight seal.

In lieu of a removable end cap, the device 10 could comprise a tube 12 having an integrally closed end portion.

To seal the open end 16 of the tube, a substantially cylindrical, removable end cap 18 is provided. When properly positioned, the cap 18 forms with the tube 12 a substantially airtight container. The cap 18 is sized to snugly fit within the end of the tube. It comprises a cylindrically shaped member 26 having a bore 32 for receiving the normally flattened, unlit, wetted tip of the cigar. During smoking, many cigar smokers chew on the tip of the cigar causing it to acquire a flattened appearance. The bore 32 preferably has a shape or configuration similar to that of a truncated cone which reshapes the unlit cigar tip and substantially restores the taper to the cigar tip. In addition, the cap 18 has a punch pin 50 with a pointed end 52. Ideally, the pin 50 is positioned centrally within the bore. When the cap is placed over the end of a cigar, the pin 50 punches a hole in the cigar tip. Later when the cigar is removed for further smoking, a user does not have to bite the tip or use a separate tool to punch a hole in the tip. The pin 50 may be mounted to the cap 18 in any suitable manner.

To insure the formation of a good seal between the cap 18 and the tube 12, an integrally formed lip 31 is provided for abutting against an end wall of the tube. In addition, means for positively locking the cap 18 to the tube 12 is provided. The locking means comprises a substantially L-shaped slot 28 in the tube 12 and a flange 30 preferably formed as an integral part of the cap 18 to lock the cap 18 in place, the flange 30 is inserted into the slot 28 and the cap is rotated until the flange is in the position shown in FIG. 3. The cap 18 and the flange 30 may be formed from any suitable material known in the art. Preferably, they are formed from the same material as tube 12 and end cap 14.

A snuffer 20 is provided within the tube 12 for extinguishing the cigar 11. The snuffer 20 preferably comprises a cylindrical member 21 having a bore 24 for receiving the lighted end of the cigar. Preferably, the bore 24 is in the shape of a truncated cone. The snuffer 20 is sized to permit relative sliding movement between it and the tube. By providing such an arrangement, cigars of different lengths can be accommodated. A spring 22 such as a helical spring is provided within the tube 12 to restore the snuffer 20 to a desired initial position. The spring 22 is preferably connected or locked to the snuffer 20 and the end cap 14 or the end portion of the tube. Grooves 15 and 23 may be provided in the end cap 14 and the snuffer 20 respectively for locking the spring 22 in place.

It has been found that when a cap 18 is placed over the end of a cigar and locked in position that the cap forces the lighted cigar against the snuffer 20. This helps create sufficient pressure that the lighted cigar is substantially instantaneously extinguished.

While the snuffer 20 may be formed from any desired material, it is preferably formed from a thermally conductive metal such as aluminum or a metal alloy. The use of a metallic snuffer is desirable for permitting heat from the lighted end of the cigar to be dissipated.

To permit the device to be worn in a pocket of the user's apparel, a clip 34 is provided. The clip 34 may comprise any suitable clip device known in the art. For example, the clip 34 may be a slidable clip having a portion for overlapping the user's pocket and an integral ring element 36 substantially surrounding the outer periphery or exterior of the tube 12. Such a clip 34 is useful because it permits the device 10 to be used with different sized pockets. Alternatively, the clip could be an integral part of the tube 12.

The device 10 is used by inserting the lighted end of a cigar 11 into the tube 12 until it contacts the bottom of the bore 24 in the snuffer 20. The cap 18 is placed over the unlit end of the cigar and is used to push the cigar towards the closed end 13 of the tube. This causes the snuffer 20 to move towards the closed end 13 and the spring 22 to become compressed. The cap 18 is inserted into the open end of the tube 12 until the flange 30 hits the bottom of the slot 28. The cap 18 is then rotated until the flange 30 is in its locked position. Since the cap 18 forms a substantially airtight container with the tube 12, the cigar is rapidly extinguished. The bore in the cap meanwhile reshapes the unlit tip of the cigar while the pin punches a hole in the tip.

When the user wishes to smoke the cigar again, the cap 18 is rotated until the flange 30 is in its unlocked position. The cap 18 is then removed from the tube 12. The spring 22 causes the cigar 11 to extend outwardly of the tube 12. Ultimately, the spring restores the snuffer 20 to its initial position.

While the device of the present invention is designed to extinguish lighted cigars, it may also be used to store a new cigar. The device will prevent the cigar from breaking and will keep it fresh. The pin in the cap will poke a hole in the end of the cigar so that upon removal of the cigar, the user need only light a match to start smoking.

It is apparent that there has been provided in accordance with this invention a device for extinguishing and for saving cigars which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A device for rapidly extinguishing a lighted cigar and for saving said extinguished cigar for later consumption which comprises:

a hollow cylindrical tube having a closed end portion and an open end portion opposed thereto;

a first removable cap adapted to fit within said open end portion for sealing the open end so as to form a substantially airtight container and thereby promote rapid extinguishment of said lighted cigar;

said cap having a bore configured to receive to receive and reshape an unlit end of a cigar; and a pin mounted to said cap for punching a hole in said unlit end of said cigar, said pin being centrally located within said bore.

2. A device according to claim 1 which further comprises means for snuffing said lighted cigar positioned within said tube, said snuffing means being adapted to move relative to said tube to accommodate cigars of different lengths.

3. A device according to claim 2 wherein said cap has means for positively locking said cap to said tube so that said cap creates sufficient pressure between the snuffing means and the lighted end of the cigar to cause the cigar to be substantially instantaneously extinguished.

4. A device according to claim 3 wherein said tube has a slot and said positive locking means comprises a flange on said cap for engaging said slot in said tube.

5. A device according to claim 4 wherein said slot comprises a substantially L-shaped slot.

6. A device according to claim 2 which further comprises a spring connected to a portion of said cylindrical tube and said snuffing means for adjusting said snuffing means so as to accommodate cigars of different lengths.

7. A device according to claim 2 wherein said snuffing means is formed by a substantially cylindrically shaped member having a bore shaped to receive the lighted end of said cigar.

8. A device according to claim 2 wherein said snuffing means is formed from a thermally conductive material and said tube and said cap are each formed from a substantially impact resistant, substantially non-combustible material.

9. A device according to claim 8 wherein said snuffing means is formed from aluminum or an aluminum alloy and said tube and cap are formed from a plastic material.

10. A device according to claim 1 which further comprises means for permitting said device to be clipped to a user's apparel.

11. A device according to claim 10 wherein said clip means comprises a clip attached to a ring member which substantially surrounds the exterior of said tube and which is slidable relative to said tube to permit said device to fit into different sized pockets.

12. A device according to claim 1 wherein the closed end of said tube is formed by a second removable end cap inserted within an opening in said tube.

13. A device according to claim 12 wherein said second removable cap has means for positively locking said cap to said tube.

14. A device according to claim 13 wherein said tube has at least one second slot and said locking means on said second removable cap comprises at least one flange adapted to engage said at least one second slot.

* * * * *